US006661169B2

(12) United States Patent
Hsu

(10) Patent No.: US 6,661,169 B2
(45) Date of Patent: Dec. 9, 2003

(54) REAR PLATE OF A PLASMA DISPLAY PANEL AND METHOD FOR FORMING PLASMA DISPLAY PANEL RIBS

(75) Inventor: Kuo-Pin Hsu, Kaohsiung Hsien (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/097,051

(22) Filed: Mar. 12, 2002

(65) Prior Publication Data

US 2002/0130617 A1 Sep. 19, 2002

(30) Foreign Application Priority Data

Mar. 13, 2001 (TW) ..... 90105813 A

(51) Int. Cl.[7] ..... H01J 61/00
(52) U.S. Cl. ..... 313/581; 445/24
(58) Field of Search ..... 313/582, 581, 313/610, 611, 586, 587; 445/24, 23

(56) References Cited

U.S. PATENT DOCUMENTS 5,541,479 A * 7/1996 Nagakubo ..... 313/586
5,860,843 A * 1/1999 Kasahara ..... 445/24
6,428,945 B1 * 8/2002 Lin et al. ..... 430/321
6,508,685 B1 * 1/2003 Lee et al. ..... 445/24

FOREIGN PATENT DOCUMENTS

JP 404259733 A * 9/1992

* cited by examiner

*Primary Examiner*—Don Wong
*Assistant Examiner*—Thuy Vinh Tran
(74) *Attorney, Agent, or Firm*—Ladas & Parry

(57) ABSTRACT

This invention provides a rear plate of a plasma display panel (PDP) and the method for forming PDP ribs thereon. The address electrodes and the base plates are formed on a glass substrate. The address electrodes and the base plates are formed alternately. A rib material layer is formed over the address electrodes, the base plates and the glass substrate. A patterned mask layer is formed on the rib material layer. The rib material layer is further sandblasted to form the ribs according to the shape of the base plates. The rib material directly located on the glass substrate is easily removed because the adhesion between the rib material layer and the base plates is better than the adhesion between the rib material layer and the glass substrate.

19 Claims, 4 Drawing Sheets

REAR PLATE OF A PLASMA DISPLAY PANEL AND METHOD FOR FORMING PLASMA DISPLAY PANEL RIBS

BACKGROUND OF THE INVENTION

1. Field of the Invention

The present invention relates in general to a plasma display panel (PDP). In particular, the present invention relates to a rear plate of a PDP and the method for forming ribs thereon.

2. Description of the Related Art

Recently, a variety of flat panel displays, such as a liquid crystal display (LCD) and a plasma display panel (PDP) have been intensively developed to replace cathode ray tube (CRT) displays. In PDP technololgy, an ultraviolet light is emitted to excite the RBG phosphors to produce visible lights. The advantages of the PDP include a large display area, wide viewing angle, and intense brightness.

The PDP has a front plate and a rear plate spaced apart to each other with the peripheries thereof sealed. In general, the PDP includes barrier ribs for partitioning the discharge spaces. The barrier ribs prevent discharge coupling and color cross-talk between adjacent cells. The traditional method for forming the ribs is described hereafter with FIGS. 1A and 1B.

As shown in FIG. 1A, the address electrodes 12 are formed on the glass substrate 10. The dielectric layer 14 is formed to protect the address electrodes 12 after sintering. The rib material layer 16 is formed on the dielectric layer 14. The dry film is laminated on the rib material layer 16. After exposing and developing, the dry film 18 is patterned as shown in FIG. 1A.

Referring to 1B, the rib material layer 16 is patterned by sandblasting to form the ribs 16*a*.

In the above-mentioned traditional processes, the dielectric layer 14 under the ribs 16*a* is used to protect the address electrodes 12 from damage in the sandblasting step. A sintering step is needed after forming the dielectric layer 14, the manufacturing time is longer and the manufacturing cost is increased. Moreover, the height of the ribs 16*a* is about 100~200 $\mu$m, therefore the sandblasting time is too long to keep the uniformity of the bottom width and the profiles of the ribs 16*a*. If the lateral action between the sands and the rib material is strong in the sandblasting step, the bottom area of the ribs 16*a* will be small. The size of the ribs 16*a* affects the size of the discharging cell and the strength of the ribs 16*a*. If the width of the ribs 16*a* is narrowed, the space of the discharging cell is increased so that the coating yield of the phosphors is enhanced. Therefore, the brightness is enhanced and the consumption of power is reduced. When the width the ribs 16*a* is too smaller, the strength of the ribs 16*a* is also reduced. The height of the ribs 16*a* is very high now, if the width of the ribs 16*a* is further reduced or the height is further increased, the stability of the ribs 16*a* is damaged and these ribs 16*a* may collapse.

SUMMARY OF THE INVENTION

The present invention provides a method for fabricating ribs of a PDP. In this method, one sintering step can be eliminated, the width of the rib and the profile of the ribs can all be effectively controlled, and the space of the discharging cell can be increased without damaging the stability of the rib.

The present invention provides a method for forming PDP ribs. First, a plurality of address electrodes and base plates are formed on the glass substrate. The address electrodes and the base plates alternate with each other, and a predetermined distance is formed between each address electrode and each base plate. A rib material layer is formed above the address electrodes, the base plates and the glass substrate. A patterned mask layer is formed on the rib material layer. The rib material layer is sandblasted to form a plurality of ribs accord to the pattern of the base plates. The shape of the base plates can be changed on demand so the structure of the ribs can be changed. Alternatively, a passivative film can be formed on the address electrodes to prevent from damage in the sandblasting step.

The present invention also provides a rear plate of the plasma display panel (PDP). The rear plate includes a glass substrate, a plurality of address electrodes, a plurality of base plates, and a plurality of ribs. The address electrodes and the base plates alternate with each other and are parallel to each other. There is a predetermined distance between each address electrode and each base plate. The ribs are disposed on the base plates, and the bottom width of each rib is the same as that of each base plate.

BRIEF DESCRIPTION OF THE DRAWINGS

The present invention will become more fully understood from the detailed description given herein and the accompanying drawings, given by way of illustration only and thus not intended to be limitative of the present invention.

DETAILED DESCRIPTION OF THE PREFERRED EMBODIMENT

Figure 1A:
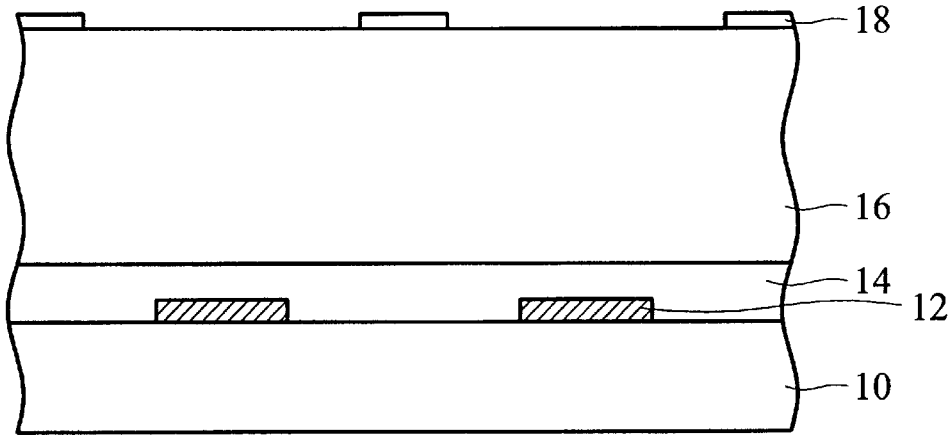
FIG. 1A ( PRIOR ART )
FIGS. 1A~1B depict the method for fabricating the ribs of the PDP in the prior art.
Figure 1B:
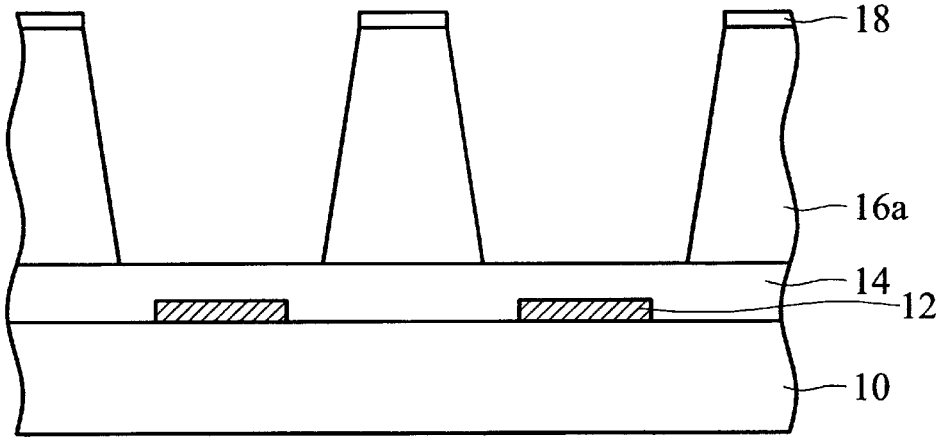
FIG. 1B ( PRIOR ART )
Figure 2A:
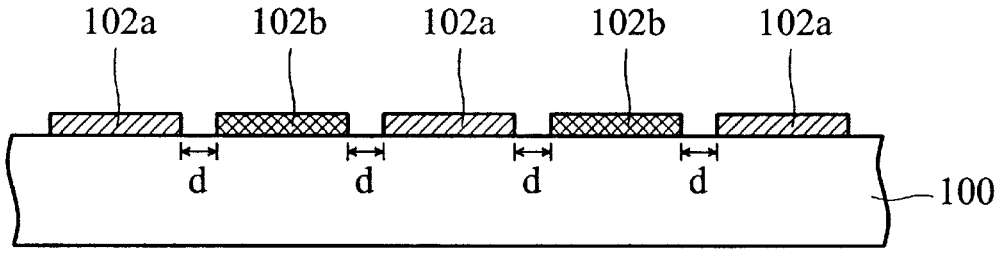
FIGS. 2A~2D depict the method for forming the ribs of PDP according to the present invention.
Figure 2B:
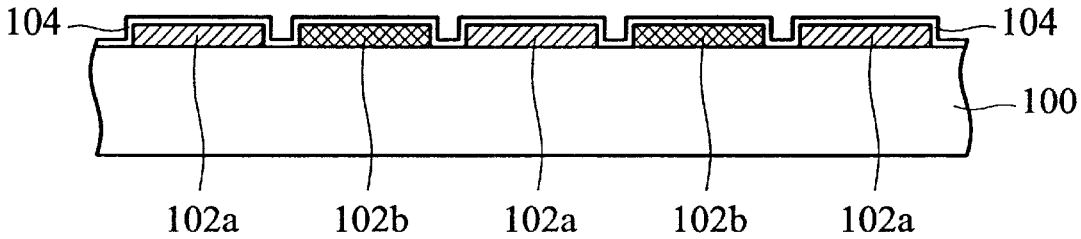
Figure 2C:
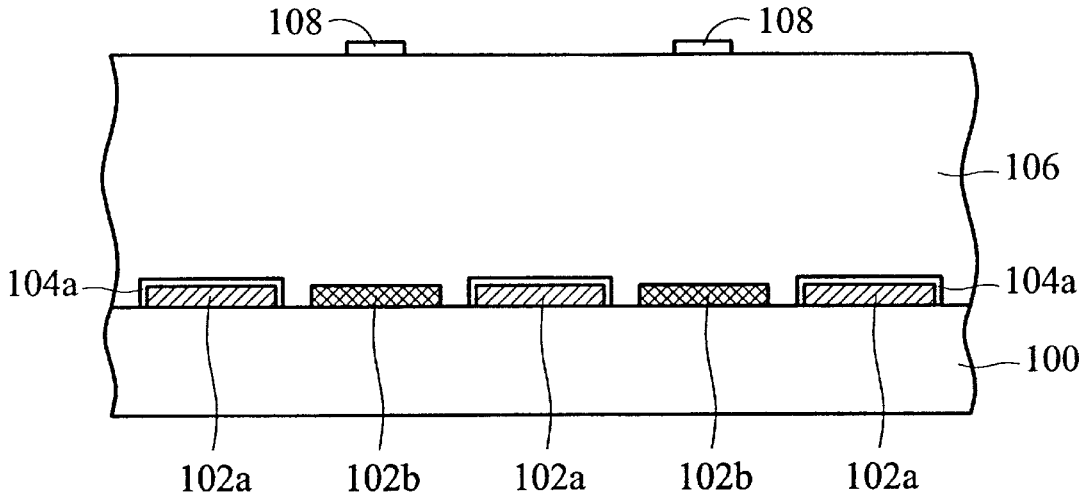
Figure 2D:
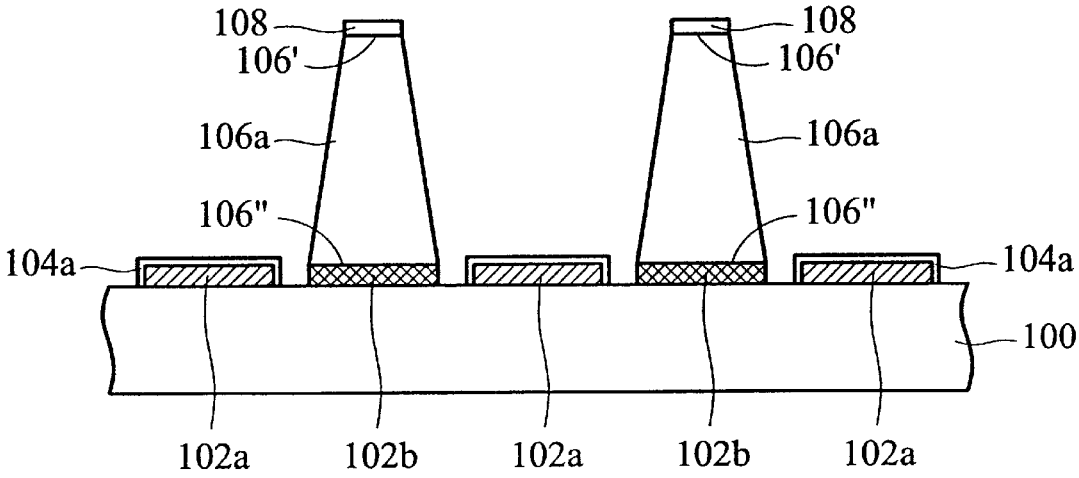

In the present invention, the rear plate of the PDP includes the glass substrate 100, the address electrodes 102*a*, the base plates 102*b*, and the ribs 106*a*, as shown in FIG. 2D. The address electrodes 102*a* and the base plates 102*b* are formed in the same process, and arranged in parallel and alternate with each other. A predetermined distance is defined between each address electrode 102*a* and each base plate 102*b*. The ribs 106*a* are disposed above the base plates 102*b*. Each rib has a bottom width and each base plate has a base width, and the bottom width of each rib 106*a* is the same as the base width of the base plate 102*b*. Alternatively, the passivative film 104*a* can be formed on the address electrodes 102*a*.

A detailed description of the method for forming the above-mentioned ribs of PDP is given hereafter with reference to FIGS. 2A~2D.

Referring to FIG. 2A, the address electrodes 102*a* and the base plates 102*b* are formed on the glass substrate 100. The address electrodes 102*a* and the base plates 102*b* can be made by the same process and the same material. Specifically, the material used to form the address electrodes 102*a* or the base plates 102*b* includes conductive material, such as silver (Ag), photosensitive polymer, and glass frit for forming the rib. The address electrodes 102*a* and the base plates 102*b* can be patterned by exposing once or twice, then developing and sintering. The temperature of the sintering step is about 500~550° C. The predetermined distance d between each address electrode 102*a* and each base plate 102*b* is about 20~50 $\mu$m. The base width of each base plate 102*b* is about 140~150 $\mu$m.

Note that the base plates 102*b* are floating although the base plates 102*b* are formed by the conductive material.

With Reference to FIG. 2B, passivative film 104 is laminated on the glass substrate 100, address electrodes 102*a* and base plates 102*b* with a thickness of 5~15 μm. The material used to form the passivative film 104 incldues a photosensitive material and a dielectric material.

With Reference to FIG. 2C, after the passivative film 104 is exposed and developed, the passivative films 104*a* only cover the address electrodes 102*a*. Alternatively, the passivative film 104*a* can be formed by directly screen-printing the organic binder on the address electrodes 102*a*. Moreover, if the sandblasting process is controlled well, the passivative film 104*a* can be omitted.

The rib material layer 106 having a predetermined thickness is further formed on the glass substrate 100, the passivative film 104*a* and the base plates 102*b*. The patterned mask layer 108 is formed on the rib material layer 106. The thickness of the patterned mask layer 108 is about 30~100 μm. For example, the patterned mask layer 108 can be formed by laminating the photosensitive dry film on the rib material layer 106, then the photosensitive dry film is patterned by exposing and developing.

The sandblasting process is conducted to pattern the rib material layer 106 and removes the parts of the rib material 106 uncovered by the patterned mask layer 108 to form the ribs 106*a*. The patterned mask layer 108 is then removed. The rear plate of the PDP is thus formed.

It should be noted that the bottom width of the bottom 106" of the rib 106*a* is decided by the base width of each base plate 102*b*. The roughness of the base plate surface is larger than the roughness of the glass substrate surface because the base plates 102*b* is composed of conductive materials. The adhesion between the rib material layer 106 and the base plates 102*b* is better than the adhesion between the rib material layer 106 and the glass substrate 100. The part of the rib material layer 106 located on the glass substrate 100 is easily removed in the sandblasting process. Therefore, the bottom width of the bottom 106" of the rib 106*a* equals the base width of each base plate 102*b*. The top width of the top 106' of the rib 106*a* is decided by the patterned mask layer 108. Therefore, the top width of the top 106' and the bottom 106" of each rib 106*a* can be adjusted on demand.

Figure 3:
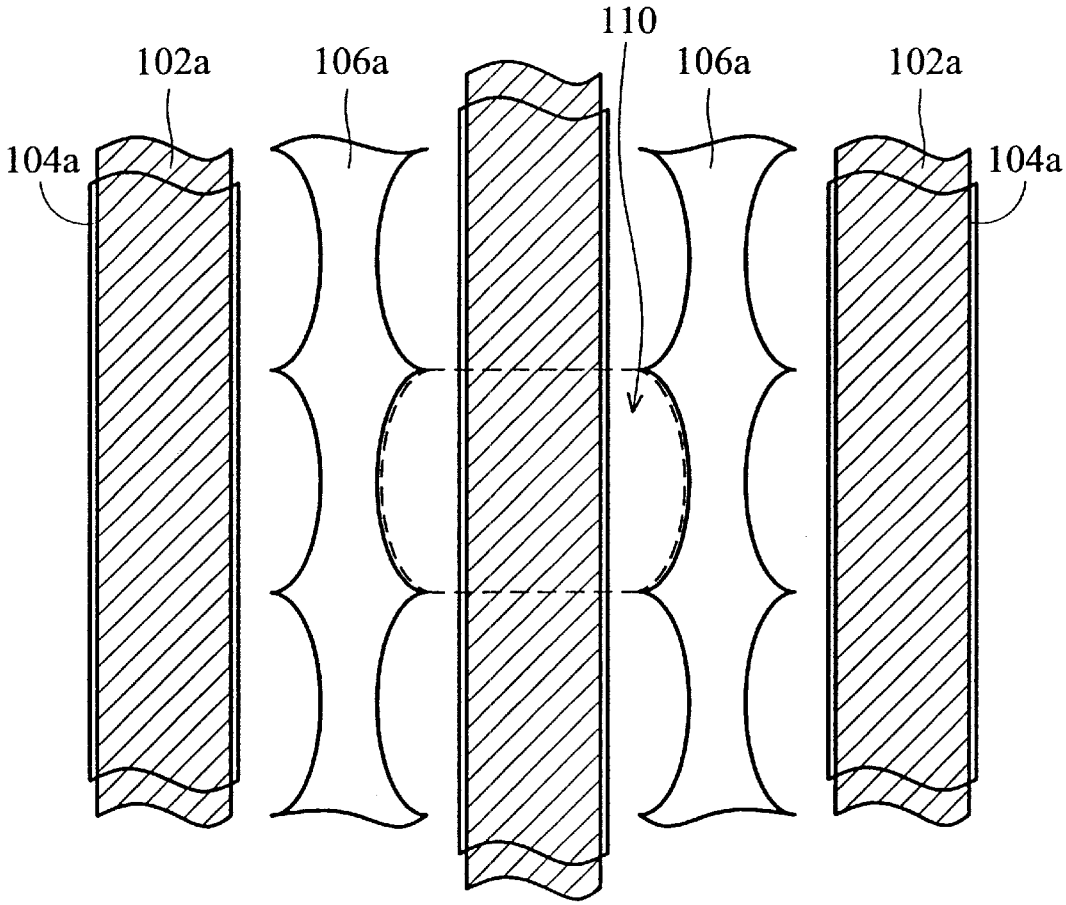
FIG. 3 depicts the top view of a rib in the present invention.

Moreover, the bottom width of the bottom 106" of the rib 106*a* can be altered by the shape of the base plate 102*b*. The base plate 102*b* can be the traditional straight shape or the zigzag shape, as shown in FIG. 3. In FIG. 3, the central width of the base plate 102*a* is reduced, the discharging space of each discharging cell 110 is then increased, thus the luminescent efficiency is enhanced. The brightness of the PDP is further enhanced and electric power is saved.

According to the present invention, no dielectric material is needed above the address electrodes. Instead, the passivative film on the address electrodes is just a dry film, no sintering process is needed. Therefore, the sintering step for sintering the dielectric layer on the address electrodes can be eliminated, resulting in a decrease in costs and enhancement of the performance of the PDP.

Further, the ribs can be shaped by adjusting the base plates under the rib material layer.

Furthermore, the discharging space of each discharging cell can be increased by shaping the base plates. Parts of the rib are narrowed to increase discharging space, thereby enhancing the brightness of the PDP and conserving electric power without sacrificing the stability of the ribs.

Moreover, the bottom width of each rib is adjusted by each base plate, and the top width of each rib is adjusted by the patterned mask layer. Therefore, it is easy to alter the shape of the ribs, and the processes are flexible.

While the present invention is described by preferred embodiments, it should be understood that the invention is not limited to these embodiments in any way. On the contrary, it is intended to cover all the modifications and arrangements as they would be apparent to those skilled in the art. Therefore, the scope of the appended claims should be interpreted in the broadest sense so as to encompass all the modifications and arrangements.

What is claimed is:

1. A method for forming plasma display panel (PDP) ribs, comprising:

providing a glass substrate;

forming a plurality of address electrodes and base plates which alternate with each other on the glass substrate, and a predetermined distance being defined between each address electrode and each base plate;

forming a passivative film on the address electrodes;

forming a rib material layer over the passivative film, the base plates and the glass substrate;

forming a patterned mask layer on the rib material layer; and sandblasting the rib material layer to form a plurality of ribs corresponding to the base plates.

2. The method as claimed in claim 1, wherein materials of the address electrodes and the base plates are substantially the same.

3. The method as claimed in claim 1, wherein the process of forming the passivative film comprises:

(a) laminating a dry film having a photosensitive component and a dielectric material above the address electrodes, the base plates, and the glass substrate; and (b) patterning the dry film by a lithographic process so as to form the passivative film above the address electrodes.

4. The method as claimed in claim 1, wherein the passivative film is formed by a screen-printing process, and the passivative film having an organic adhesive is screen-printed on the address electrodes.

5. The method as claimed in claim 1, wherein the predetermined distance between each address electrode and each base plate is between 20 and 50 μm.

6. The method as claimed in claim 1, wherein each base plate has a width in a range between 140 and 150 μm.

7. The method as claimed in claim 1, wherein the base plates are in a straight shape.

8. The method as claimed in claim 1, wherein the base plates have a zigzag shape.

9. A rear plate of a plasma display panel, comprising:

a glass substrate;

a plurality of address electrodes and a plurality of base plates alternately located on the glass substrate, and a predetermined distance being formed between each address electrode and each base plate;

a passivative film positioned above the address electrodes; and a plurality of ribs located on the glass substrate, wherein each rib has a bottom width, each base plate has a base width, and the bottom width of the rib is substantially the same as the base width of the base plate.

10. The rear plate of the PDP as claimed in claim 9, wherein the predetermined distance between each address electrode and each base plate is between 20 and 50 μm.

11. The rear plate of the PDP as claimed in claim 9, wherein the bottom width of each base plate is between 140 and 150 $\mu$m.

12. The rear plate of the PDP as claimed in claim 9, wherein the base plates are in a straight shape.

13. The rear plate of the PDP as claimed in claim 9, wherein the base plates are in a zigzag shape.

14. A method for forming plasma display panel (PDP) ribs, comprising:

providing a glass substrate;

simultaneously forming a plurality of address electrodes and base plates which alternate with each other without contact therebetween on the glass substrate with a predetermined distance between each address electrode and each base plate;

forming a rib material layer over the address electrodes, the base plates and the glass substrate;

forming a patterned mask layer on the rib material layer; and sandblasting the rib material layer to form a plurality of ribs corresponding to the base plates.

15. The method as claimed in claim 14, further comprising a step of forming a passivative film on the address electrodes.

16. The method as claimed in claim 14, wherein the base plates are in a straight shape or a zigzag shape.

17. A rear plate of a plasma display panel (PDP), comprising:

a glass substrate;

a plurality of address electrodes and a plurality of base plates substantially having the same materials alternately located on the glass substrate without contact therebetween with a predetermined distance formed between each address electrode and each base plate; and a plurality of ribs located on the glass substrate, wherein each rib has a bottom width, each base plate has a base width, and the bottom width of the rib is substantially the same as the base width of the base plate.

18. The rear plate of the PDP as claimed in claim 17, further comprising a passivative film positioned above the address electrodes.

19. The rear plate of the PDP as claimed in claim 17, wherein the base plates are in a straight shape or a zigzag shape.

* * * * *